US006591589B2

(12) United States Patent
Cook

(10) Patent No.: US 6,591,589 B2
(45) Date of Patent: Jul. 15, 2003

(54) BITLESS BRIDLE FOR GOVERNING HORSES AND OTHER ANIMALS

(76) Inventor: W. Robert Cook, 206 Birch Run Rd., Chestertown, MD (US) 21620

( * ) Notice: Subject to any disclaimer, the term of this patent is extended or adjusted under 35 U.S.C. 154(b) by 0 days.

(21) Appl. No.: 09/829,907

(22) Filed: Apr. 11, 2001

(65) Prior Publication Data

US 2002/0148207 A1 Oct. 17, 2002

(51) Int. Cl.[7] ..... B68B 1/04
(52) U.S. Cl. ..... 54/6.1; 54/6.2
(58) Field of Search ..... 54/6.1, 6.2; 119/826, 119/828, 829

(56) References Cited

U.S. PATENT DOCUMENTS

| | | | | |
|---|---|---|---|---|
| 184,296 A | | 11/1876 | Poorman | |
| 278,988 A | * | 6/1883 | Massey | 54/6.1 |
| 453,943 A | * | 6/1891 | Schmitz | 54/6.1 |
| 518,423 A | | 4/1894 | McLeod | |
| 734,004 A | * | 7/1903 | Stiegler | 54/6.2 |
| 897,329 A | | 9/1908 | Weber | |
| 1,135,570 A | | 4/1915 | Duehr | |
| 1,351,620 A | | 8/1920 | Canter | |
| 1,746,403 A | | 2/1930 | Mulcahy | |
| 1,796,698 A | | 3/1931 | Winslow | |
| 2,193,451 A | | 3/1940 | Fryer | |
| 3,263,399 A | * | 8/1966 | Faragher | 54/6.1 |
| 3,731,456 A | | 5/1973 | Hill | |
| 3,851,446 A | | 12/1974 | Bischeltsrieder | |
| 3,906,707 A | * | 9/1975 | Morgan | 54/71 |
| 3,998,033 A | | 12/1976 | Watkins et al. | |
| 4,459,795 A | * | 7/1984 | Le Tixerant | 54/6.2 |
| 4,472,925 A | | 9/1984 | Woodruff | |
| 4,495,752 A | | 1/1985 | Simpson | |
| 4,495,753 A | | 1/1985 | Simpson | |
| 4,565,055 A | | 1/1986 | Simpson | |
| 4,589,248 A | | 5/1986 | Ruddock et al. | |
| 4,722,171 A | | 2/1988 | Meroth | |
| 5,660,031 A | | 8/1997 | Clark | |

FOREIGN PATENT DOCUMENTS

| | | |
|---|---|---|
| EP | 0 203 285 | 12/1986 |
| GB | 370831 | 4/1932 |
| WO | 99/62331 | 12/1999 |

OTHER PUBLICATIONS

U.S. application Ser. No. 09/030,632 (abandoned).

* cited by examiner

*Primary Examiner*—Peter M. Poon
*Assistant Examiner*—Joan M. Olszewski
(74) *Attorney, Agent, or Firm*—Nixon Peabody LLP; Tim L. Brackett, Jr.

(57) ABSTRACT

A bitless bridle for humanely, physiologically and effectively restraining and controlling a horse or other animal at rest and at exercise comprises an elongated strap which includes a center piece at the poll, and two crossover straps at the sides, attachable to a pair of reins providing a direct link between the centerpiece and the reins. The crossover feature of the bitless bridle provides for persuasive, but non-painful, pressure to be applied to the whole of the opposite side of the head of the horse, from poll to chin or for rapid alternate pressure to be applied to both sides of the head. The centerpiece may include a plurality of holes for receiving studs for applying painless pressure on regions of special acuity at the poll and behind each ear of the animal, or may receive a separate sleeve which includes the studs in order to apply pressure over areas of special acuity. Studs of different sizes can be fitted in a range of locations, depending upon the amount of pressure required and the conformation of any particular horse or other animal.

20 Claims, 9 Drawing Sheets

BITLESS BRIDLE FOR GOVERNING HORSES AND OTHER ANIMALS

BACKGROUND OF THE INVENTION

1. Field of the Invention

The invention relates to a device for restraining and controlling horses and other animals, at rest and at exercise. More particularly, the present invention is directed to a bitless bridle which enables a horse or other animal to be controlled during both riding and driving without causing harm or discomfort to the horse or other animal.

2. Description of the Related Art

Bridles for the humane restraint and control of horses and other animals generally comprise a head gear consisting of a headstall adapted to be strapped to the horse's head, a mouthpiece or bit connected to the headstall, and a pair of reins connected at opposite ends of the bit. At exercise, whether ridden or driven, by applying pressure on one rein, the rider can pull one end of the bit backward into the horse's mouth and against the tongue, gums and lips, thereby causing the horse to turn in the direction of the pull in an effort to lessen the discomfort from the bit bearing on the tender tissue of the mouth. By applying pressure on both reins, the rider can pull the bit backward into the horse's mouth and against the soft tissues of both sides of the mouth, with the expectation that the horse will slow or stop in order to minimize its discomfort.

Such bitted bridles, however, are uncertain in their action because they initiate an adversarial relationship between the horse and rider. For example, the bit causes pain and other reactions that are not consistent with the physiology of exercise. Governance is predicated primarily upon the application of pain to induce submission. Because the bit is a foreign object placed inside the mouth of the horse, many horses react negatively to such a device. Instead of stopping, for example, they sometimes respond to pain by running away or bolting. Furthermore, many horses chew the bit, have sore mouths as a result of the bit being placed in their mouth, balk at the bit, salivate excessively or misbehave during the process of being bridled and rear their heads so that the bit cannot easily be placed in their mouths in the first instance. Moreover, it is also known that a bit in the horse's mouth often leads to cutting of the tongue, dental pain and severe bruising of the gums and underlying bone. Finally, all bits are counter-productive and contraindicated as, apart from pain, they trigger a cascade of pathophysiological effects that are incompatible with athletic performance. Therefore, bitted bridles are harmful to the horse since control is dependent on painful pressure on the acutely sensitive tissue of the mouth and they stimulate other effects that are inconsistent with the physiological needs of an exercising animal.

Various bitless bridles have been developed to maximize control yet minimize discomfort to the horse. One form of bitless bridle, the mechanical Hackamore bridle, utilizes rigid side pieces such that the application of pressure to the reins results in a pivoting or leverage action. Such bridles, however, are disadvantageous in that they apply severe pressure to the bridge of the nose and the chin and thus, braking control of the horse is predicated once again on pain and, as with the bit, upon obstructing the airway by bringing about extreme poll flexion. Furthermore, the mechanical Hackamore and other variations on this concept provide inadequate steering. Finally, none of the previously available bitless bridles, including all hackamores, sidepulls and Bosals are universally applicable to all types of horses or suitable for all types of equestrian sport or activity.

WO 99/62331 to Curran discloses a device for attachment to the head of a horse and includes a pair of straps that extend from opposite ends of a headband that passes across the back of the head and behind the ears of the horse. The device, however, fails to include a mechanism for reliably maintaining the position of the headband on the back of the head and behind the ears of the horse.

U.S. Pat. No. 5,660,031 to Clark discloses an apparatus for the ground training of an animal, comprised of an elongated main cord with an enlarged member connected to each end thereof. A pair of pressure beads are connected to the cord proximal to and spaced equidistant from a median point on the cord. A pair of pressure beads slide on the cord on opposing sides of the median point. A pair of attachment members each have a loop portion threaded to the cord with hook members projecting from the loops. The main cord is placed over the horse's poll with the pressure beads located directly behind the horse's ears and the median point of the cord centered between the horse's ears. The attachment members are connected to cheek rings on a standard stable halter such that the enlarged members of the cord hang below the cheek rings of the halter. The trainer applies pressure to the beads by pulling down on the pull cord, maintaining the pressure on the cord until the horse yields and lowers its head. As previously mentioned, this apparatus is designed as an aid to the restraint of an animal when standing in the stable, rather than as a method of control for the animal at exercise, and thus, does not function as a bridle.

U.S. Pat. No. 4,472,925 to Woodruff also discloses a halter for the ground training of animals. The halter comprises two loops which contract around the nose and poll in response to force applied to the lead shank. The loop over the poll is provided with five, fixed, metal protuberances located at regular intervals to press upon the poll of the animal. When pressure is applied to the lead shank the protuberances press against the tissues of the a poll in order to control its behavior. This device, however, is a halter, and thus, cannot be used for riding because it does not provide control at exercise.

SUMMARY OF THE INVENTION

Accordingly, it is an objective of the present invention to overcome the aforementioned disadvantages in the related art in providing a more humane, reliable, and effective way of gaining governance over a horse or like animal at rest or at exercise.

It is another object of the present invention to provide a bridle which applies painless pressure to the head of the horse or like animal to govern the horse or like animal at rest or at exercise.

These and other objects may be achieved in an exemplary embodiment in accordance with the present invention using a bitless bridle including a harness assembly for attachment to a head of the animal, and a mechanism for applying direct pressure to regions of special acuity located at a poll area and behind the ears of the animal. The harness assembly comprises an elongated cord including a crown piece and a pair of cheekstraps extending from the crown piece along the head of the animal. A nose band and chin strap are suspended from the pair of cheekstraps so as to encircle the nose and chin of the animal. The mechanism for applying direct pressure includes a centerpiece which extends over the regions of special acuity following the longitudinal axis of the head, and a pair of crossover straps connected to the centerpiece so as to cross under the chin of the animal and terminating in rings for the attachment of a pair of reins. Unlike conventional bridles, the centerpiece and the crown piece are not united, but both are prevented from sliding back on the nape of the neck of the animal during exercise by a brow band. The brow band is provided on each end with metal clasps to constrict the brow band between the center piece and the crown piece. Accordingly, such a design prevents the brow band from falling down from its recommended position below the base of the ear when the horse is ridden.

The fact that centerpiece is separate from, and thus, not attached to the crown piece is advantageous over conventional bridles and halters since the centerpiece, being a continuation of the reins, is capable of transmitting direct pressure to the poll area of the animal. A second advantage of a separate centerpiece is that the width of the centerpiece is preferably one-half of the width of a crown piece in a conventional bridle, and thus, the pressure transmitted to the poll area is greater. A third advantage is that the pressure transmitted by the centerpiece to the regions of special acuity at the poll area is not dampened by unnecessary fixation. A fourth advantage is that the option of providing a plurality of studs on the centerpiece enables horsemen to fine tune the bridle for those horses that require more pronounced pressure.

The mechanism for applying direct pressure is placed in sliding engagement with respect to the harness assembly to transmit the pressure to the regions of special acuity when rearward tension is applied to at least one of a pair of reins. Preferably, the centerpiece is provided with a plurality of studs or protuberances mounted on the inner surface thereof so as to contact the regions of special acuity of the animal. The plurality of studs is advantageous since it enables pressure to be applied to the poll of the horse or like animal sufficient to enhance control of the horse during activities such as riding or driving without causing harm or discomfort to the horse. Because the conformation and temperament of every horse is different, the size of studs may be variable and the position of the studs on the centerpiece may be adjustable to provide for a customized fit in order that they coincide with the regions of special acuity at the poll and behind the ear.

Stimulation of the regions of special acuity is part of the mechanism upon which the "braking" effectiveness of the bitless bridle relies. In addition, pressure in these regions stimulates proprioceptive, (i.e., balancing) reflexes, which adds to the peculiar effectiveness of the bitless bridle in communicating the user's desire to slow or stop. The present invention provides an advantage over conventional bridles since the bridle permits the user to apply gentle, well-distributed, and painless pressure to either one or both halves of the head. The horse or like animal may be steered by applying rearward tension on at least one of the reins which applies pressure to the opposite half of the head. The horse or like animal may be slowed or stopped by alternate pressure on both reins, which applies pressure in the form of a benevolent embrace of the whole of the head.

Unlike conventional bitless bridles in which primary control is based upon focused pressure on the nose and chin, and poll pressure is either secondary or absent altogether, the bitless bridle in accordance with the present invention applies well-distributed pressure on the entire head including regions of special acuity at the poll and behind each ear. Because control of the horse at exercise is bitless, and therefore non-invasive, painless and physiological, the bitless bridle in accordance with the present invention represents a device whereby the welfare of the horse and its athletic performance is enhanced. The bitless bridle is multifunctional and universal in its application because, unlike other bridles and halters, it can be used for all equine activities. For example, it can be used for all forms of riding, for driving, for leading a horse from the ground, for tying a horse, or for schooling a horse by longeing or long reining. The bitless bridle can be safely applied to every type of horse from Thoroughbreds to Clydesdales and for every activity from racing to riding-for-the-handicapped.

Other aspects, properties, features and advantages of this invention follow from an explanation of the preferred embodiments shown in the drawings.

BRIEF DESCRIPTION OF THE DRAWINGS

FIG. 1(*b*) shows a ventral view of a horse fitted with the elongated longitudinal loop portion of a bitless bridle in accordance with the present invention, comprising centerpiece, crossover straps and reins;

FIG. 2(*b*) shows a transverse section of a horse's head at the level of the centerpiece;

FIG. 2(*c*) shows a side view of the centerpiece with an indication of the various sizes and shapes of studs that may be used;

FIG. 2(*d*) is similar to FIG. 2(*b*) but shows a separate, detachable sleeve having the studs/protuberances;

DETAILED DESCRIPTION OF THE PREFERRED EMBODIMENTS

Figure 1B:
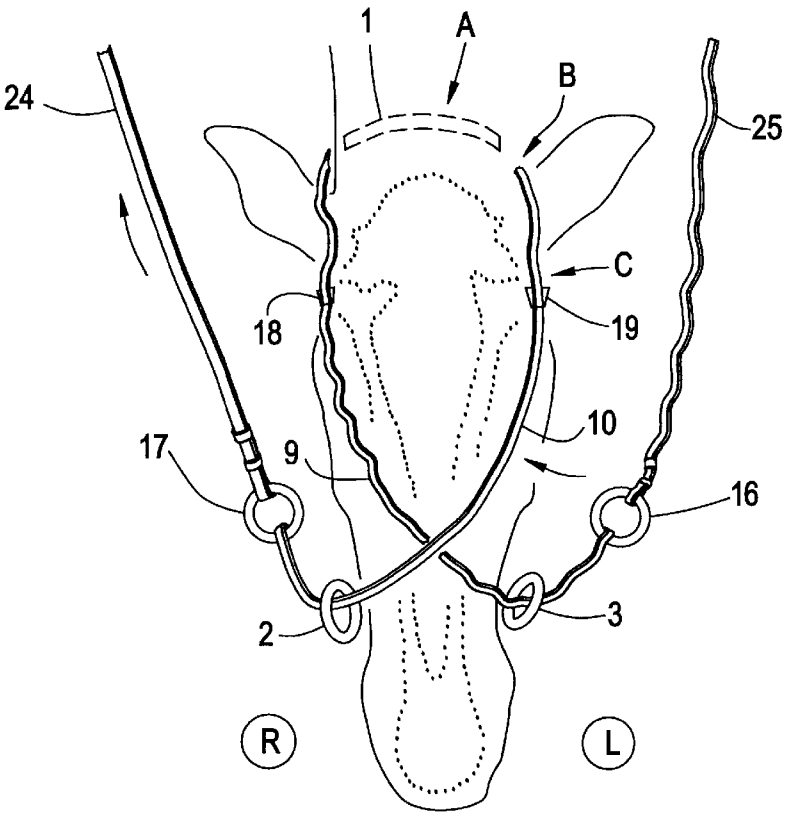
FIG. 1(*a*) shows a caudo-lateral view of a horse fitted with a bitless bridle in accordance with the present invention.
Figure 1A:
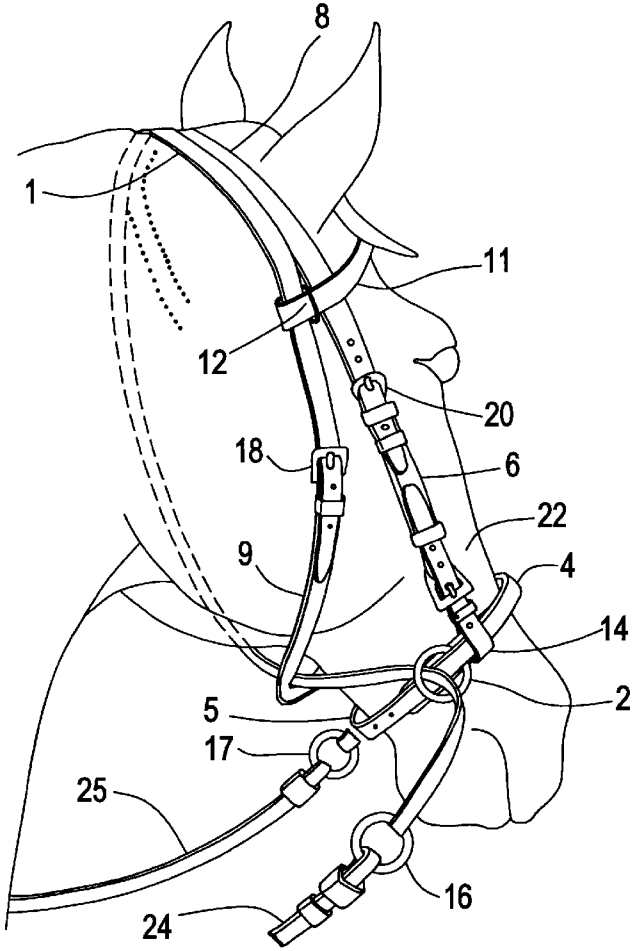
Figure 2A:
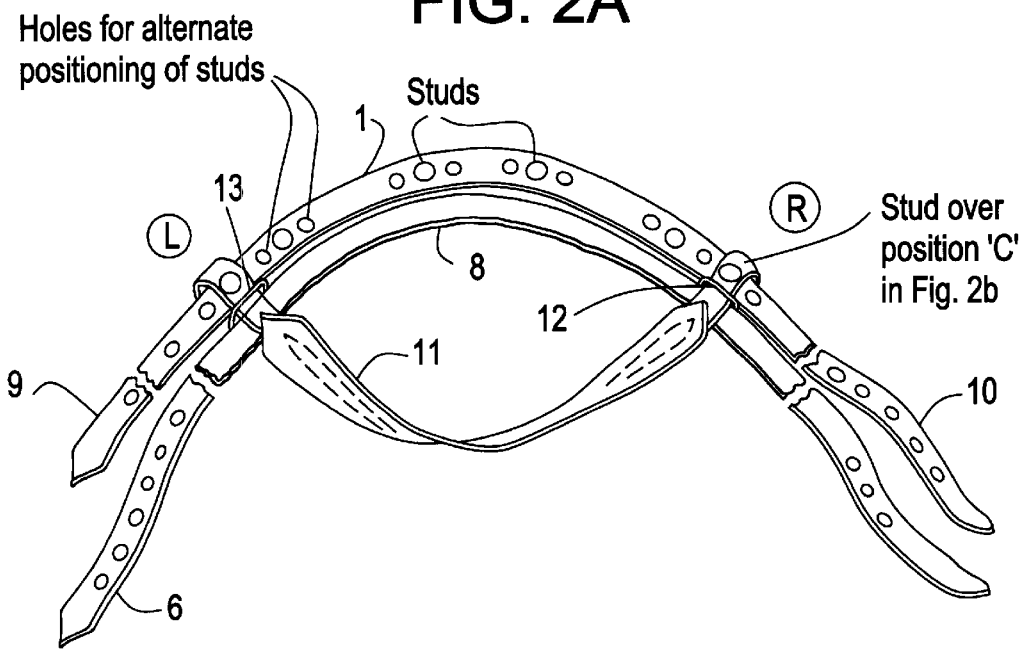
FIG. 2(*a*) shows a centerpiece, a crown piece and a brow band of the bitless bridle in accordance with the present invention.
Figure 2B:
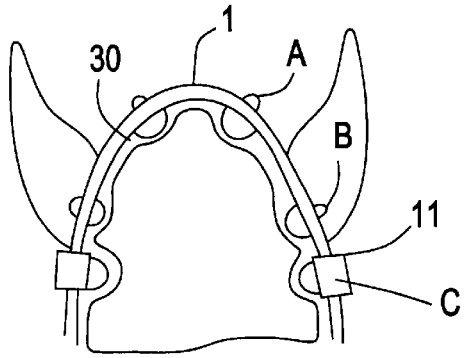
Figure 2C:
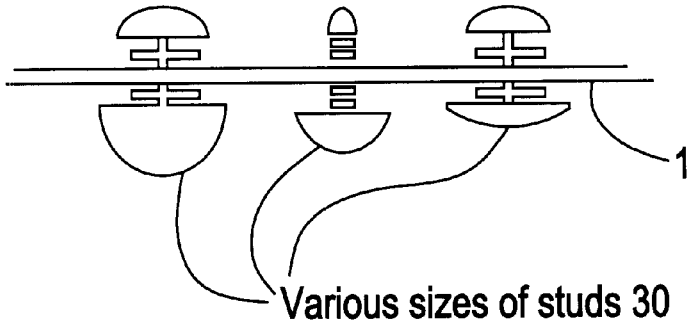
Figure 2D:
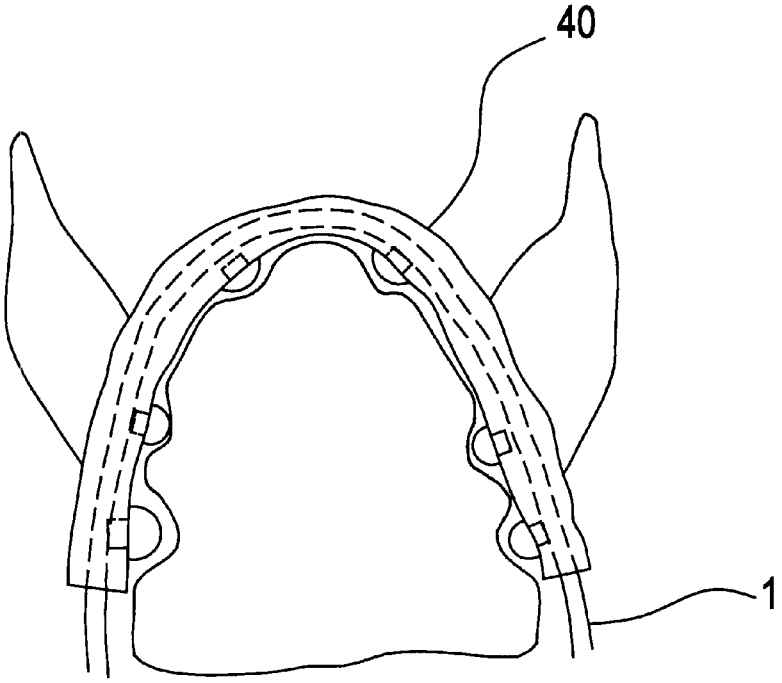

Referring now to the drawings, where FIG. 1(*a*) shows a bitless bridle including a harness assembly for attachment to the head of an animal and means for applying direct pressure to regions of special acuity (reference points A–C in FIGS. 1(*b*) and 2(*b*)) located at a poll area and behind the ears of the animal. The harness assembly comprises an elongated strap preferably composed of leather and including a crown piece 8 and a pair of cheek straps 6, 7 extending downward from the crown piece along the side of the head of the animal. A nose band 4 and chin strap 5 are suspended from the pair of cheek straps 6, 7 so as to encircle the nose and chin of the animal. A pair of rings 2, 3 are anchored to the nose band 4 and chin strap 5 at a position essentially above the mouth of the animal. The means for applying direct pressure comprises an elongated strap preferably composed of leather and including a centerpiece 1 which extends over the regions of special acuity of the animal, and a pair of crossover straps or pieces 9, 10 extending from the centerpiece 1 so as to cross under the chin of the animal and terminate in rings 16, 17 for attachment to a pair of reins 24, 25. As shown in FIGS. 1(*a*) and 1(*b*), the pair of crossover straps 9, 10 extend down the side of the face of the animal and continue under the chin and through the guide rings 2, 3 so as to cross under the chin of the animal. The crossover straps 9, 10 terminate in rings 16, 17 that are connected to the pair of reins 24, 25. In order to provide custom fitting, the lengths of the crossover straps 9, 10 can be adjusted by using a pair of buckles 18, 19. Preferably, the position of the rings 16, 17 at the end of the crossover pieces 9, 10 is approximately three to seven inches (~3–7 in.) below the guide rings 2, 3.

Figure 4:
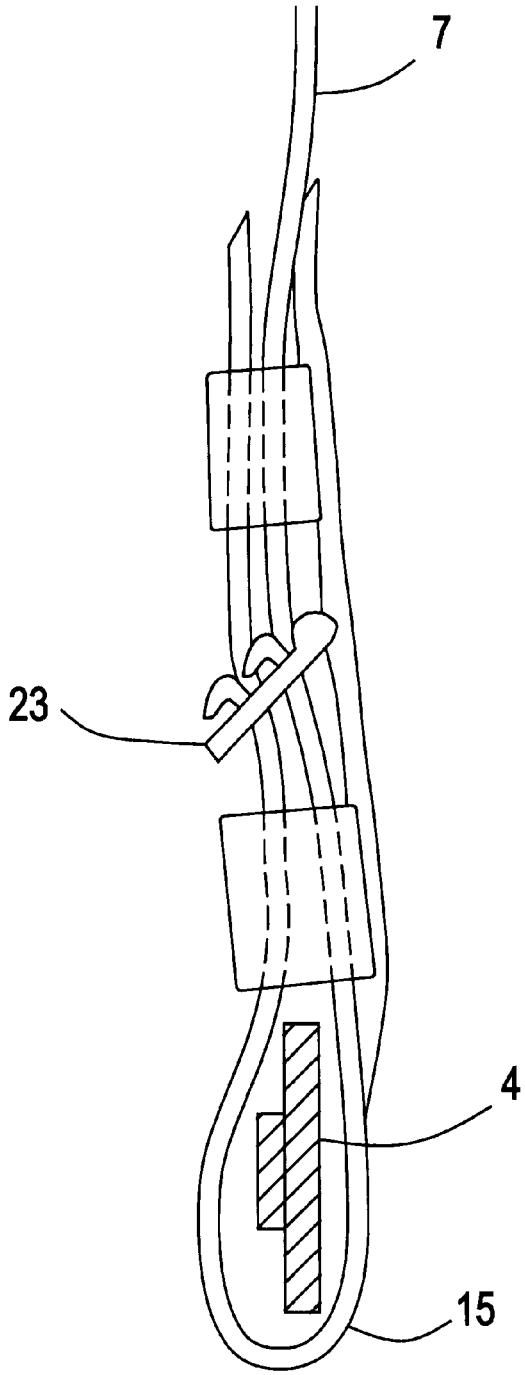
FIG. 4 shows a caudal view of the left cheek piece and noseband of the bitless bridle in accordance with the present invention.

The nose band 4 is attached on separate ends to the guide rings 2, 3 located at an area essentially above the corner of the mouth so as to form a loop at both ends around the guide rings 2, 3, while the chin strap 5 is attached at each end to the rings 2, 3 in opposition to said noseband 4. As illustrated in FIG. 1(*a*) and FIG. 4, the cheek straps 6, 7 may be fixedly attached to or simply looped around the noseband 4 by terminal loops 14, 15. The terminal loops 14, 15 may be adjusted via a pair of buckles 22, 23 to allow for a bit to be added to the bitless bridle when competition regulations require the presence of a bit. The cheek straps 6, 7 are also adjustable via buckles 20, 21 so that the noseband 4 lies as low down on the head of the animal as possible without obstructing the airway, to thereby allow the bridle to be fitted on horses or like animals of various sizes and breeds. For medium-sized horses, this requires that the bottom edge of the noseband 4 rest approximately one and a half inches (~1.5 in) above the corner of the mouth. The chin strap 5 is cinched-up snugly, so that the noseband 4 does not ride up the head of the horse when rearward tension is applied to one or both reins 24, 25. Accordingly, the correct functioning of the bitless bridle is dependent upon a nose band 4 that lies low on the head and fits snugly around the nose of the animal.

Figure 3C:
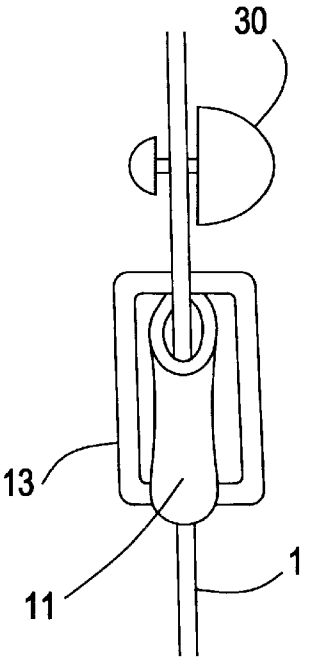
FIGS. 3(*a*)–(*c*) shows perspective views of the brow band and wire loop of the bitless bridle in accordance with the present invention.
Figure 3B:
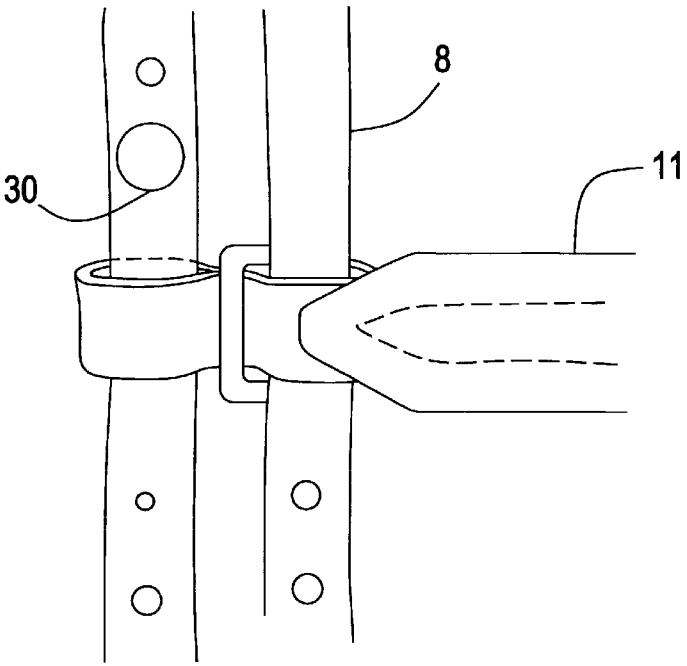
Figure 3A:
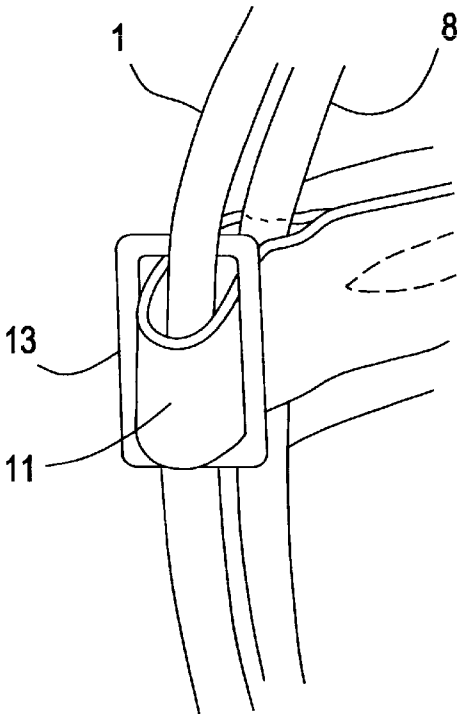

As illustrated in FIGS. 1(*a*) and 2(*a*), the centerpiece 1 and the crown piece 8 are not united, but both are prevented from sliding back on the nape of the neck of the animal during exercise by an elongated strap preferably composed of leather, serving as a brow band 11. As illustrated in FIG. 3, the brow band 11 includes a retaining mechanism including a first pair of loops through which the crown piece 8 extends for engaging in relative movement during adjustment and a second pair of loops through which the center piece 1 extends for engaging in essentially free longitudinal movement relative to the harness assembly and independent of the crown piece 8 when rearward tension is applied to at least one of the reins 24, 25. The restraining mechanism further includes clasps 12, 13, preferably composed of metal, which are disposed between the first and second pairs of loops to constrict the brow band 11 between the center piece 1 and the crown piece 8. Such a design prevents the brow band 11 from falling down from its recommended position below the base of the ear when the horse is ridden, thus, maintaining the proper position of the brow band 11. The ability of the centerpiece 1 to move longitudinally independent of the crown piece 8 when rearward tension is applied to at least one of the reins 24, 25 is advantageous since such rearward tension from at least one of the reins 24, 25 provides direct movement of only the centerpiece 1 relative to the crown piece 8 so as to control the horse or animal.

As illustrated in FIG. 2(*a*), a hole or aperture is provided at each end of the brow band 11 to receive a stud, if required. As shown in FIGS. 2(*a*) and 2(*b*), the centerpiece 1 is provided with a plurality of apertures designed to receive four studs mounted so as to project from the inner surface of the centerpiece 1 into the concavities on the head of the horse at the poll (for example, one stud shown at position C). The additional hole on the inside of the brow band loops provides for placement of a stud that will press into a concavity behind each ear. Preferably, the studs are composed of a rigid material such as steel or molded plastic and are designed to apply painless pressure on regions of special acuity at the poll and behind each ear of the animal. Stimulation by the studs of the regions of special acuity at the poll and behind each ear is part of the mechanism upon which the "braking" effectiveness of the bitless bridle relies, probably invoking thereby both acupressure responses and also proprioceptive (i.e., balancing) reflexes. By way of the crossover straps 9, 10, centerpiece 1 and studs, persuasive, but painless, pressure can be applied to either one or both sides of the horse's head, from poll to chin, when rearward tension is applied to at least one of the reins 24, 25. The same tension also applies pressure to the bridge of the nose as a result of pressure transmitted to the noseband 4 from the guide rings 2, 3.

As shown in FIGS. 2(*a*) and 2(*c*), because the conformation and temperament of every horse is different, the exact location and size of the studs may be adjustable to provide for a customized fit. As a result, the shape, size and location of the studs may be selected by a user to fit their particular horse or animal. Consequently, when tension is applied to the reins 24, 25, the studs apply pressure to points of special acuity at the poll and behind the ears. Alternatively, instead of being placed directly on the centerpiece 1, the studs may be placed on a separate sleeve 40 for attachment to the centerpiece 1 as shown in FIG. 2(*d*).

Figure 5:
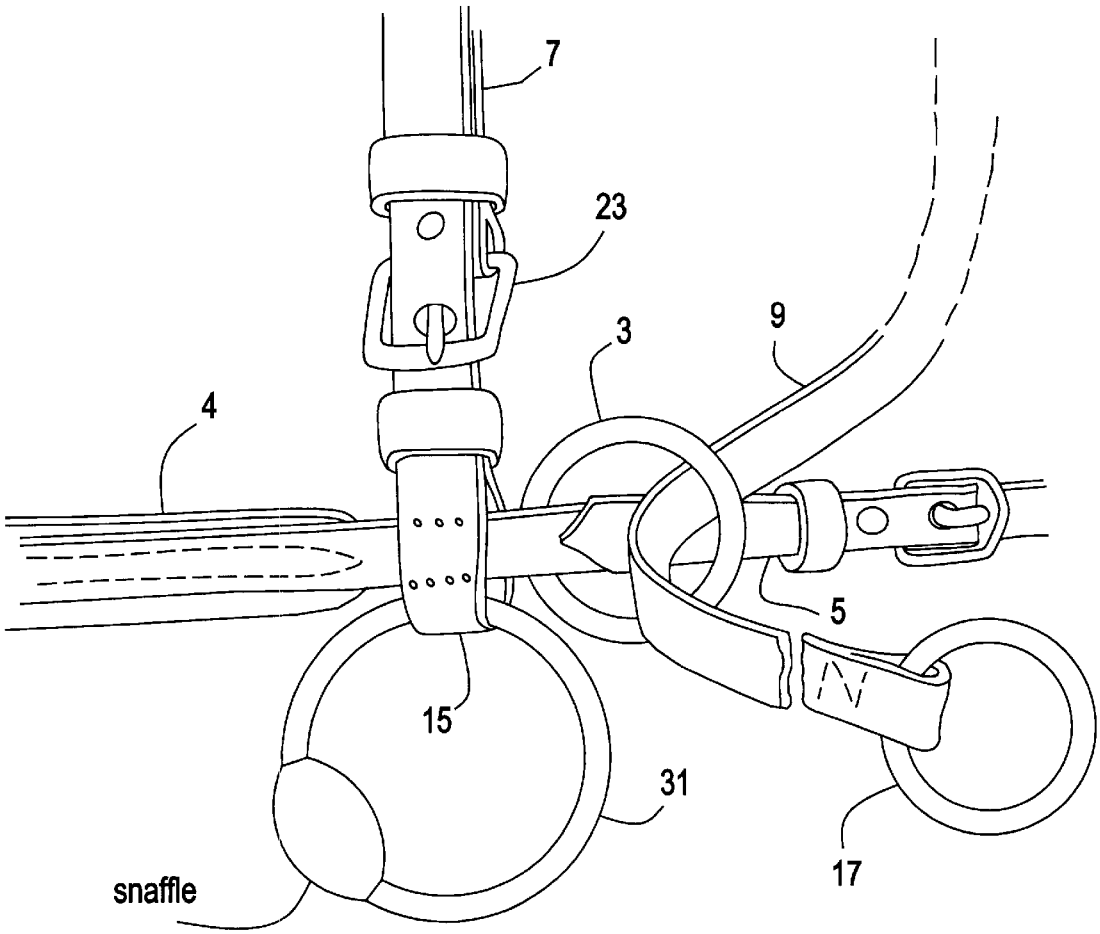
FIG. 5 shows the left side of the harness of the bitless bridle in accordance with the present invention, configured for fitting a "dummy" bit.
Figure 6:
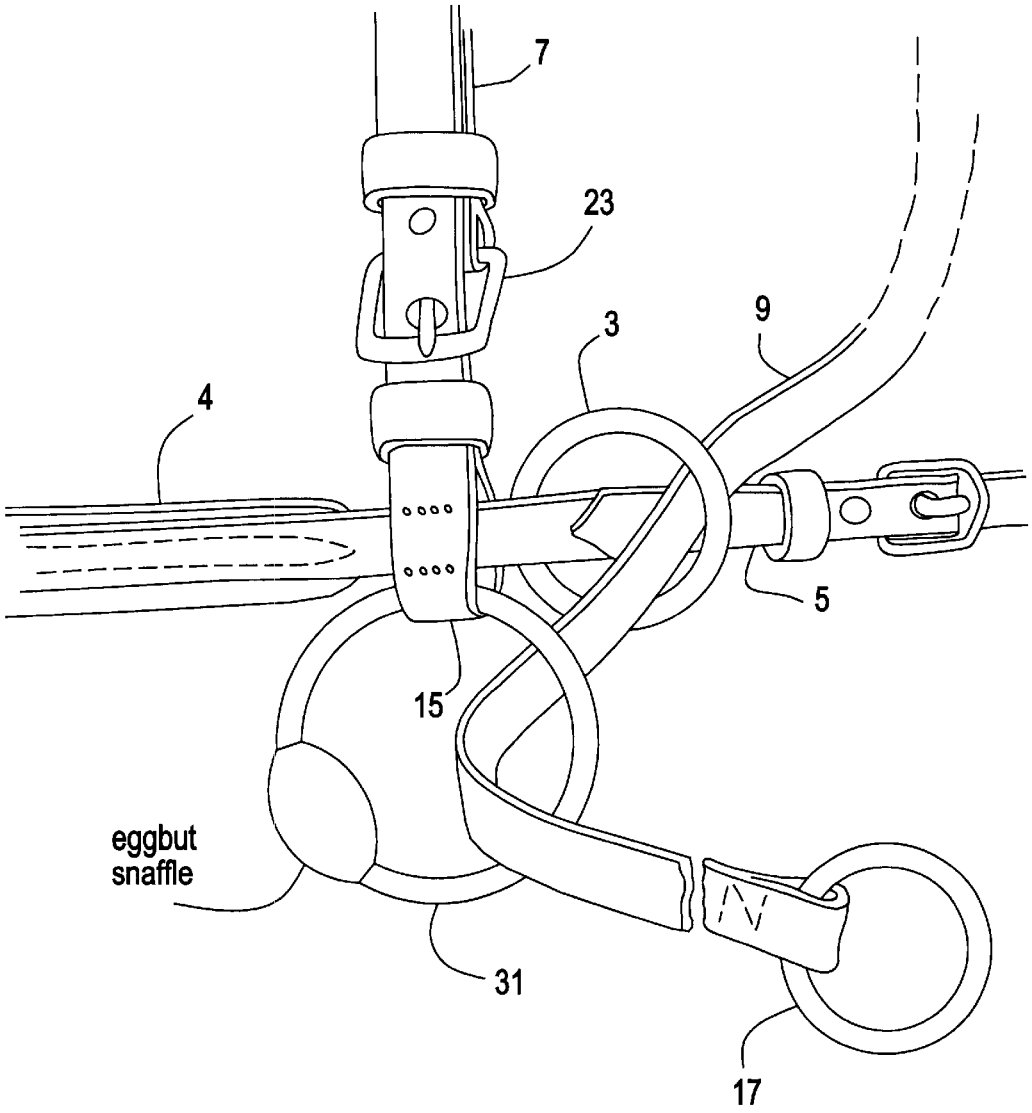
FIG. 6 shows a side view of the bitless bridle in accordance with the present invention configured for using a bit in conjunction with bitless control.

To use the head harness as a bitless bridle for controlling a horse during activities such as riding or driving, the reins 24, 25 are attached to the guide rings 16, 17 on the end of the crossover pieces 9, 10. Steering is provided by applying rearward tension to one of the reins 24, 25 so as to produce pressure from the centerpiece 1 and/or protuberances to a region of special acuity of the head opposite to the rein 24, 25 in which tension is applied. This has For use of the head harness in its bridle mode in competitive events for which the presence of a bit is required by the current regulations, the cheek pieces or straps 6, 7 are designed so that a bit can be hung from the bridle in one of two ways. As shown in FIG. 5, the bit may be suspended from the cheek pieces 6, 7 without any contact with the crossover pieces 9, 10 and, therefore, without any contact with the reins 24, 25. Alternatively, as shown in FIG. 6, the crossover pieces 9, 10 may be threaded through snaffle rings 31 of the bit before they pass through the guide rings 2, 3 on the noseband 4. This last arrangement allows for some pressure to be placed on the mouth but, compared with the amount applied in the traditional bitted bridle, the pressure is much reduced.

Figure 7:
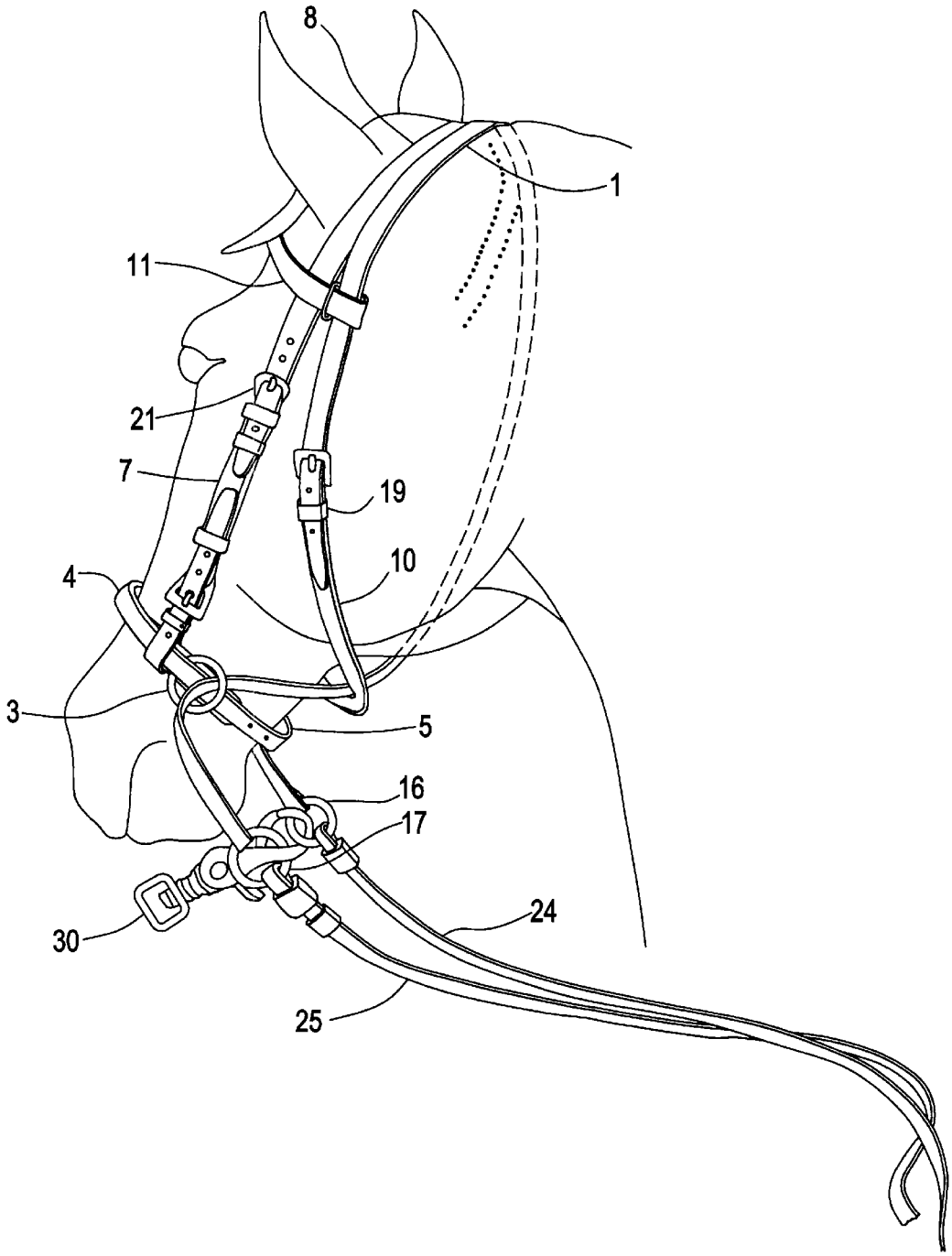
FIG. 7 shows a perspective view of the crossover straps, centerpiece and chin strap, in a manner in which the bridle can be converted into a lead-halter.
Figure 8:
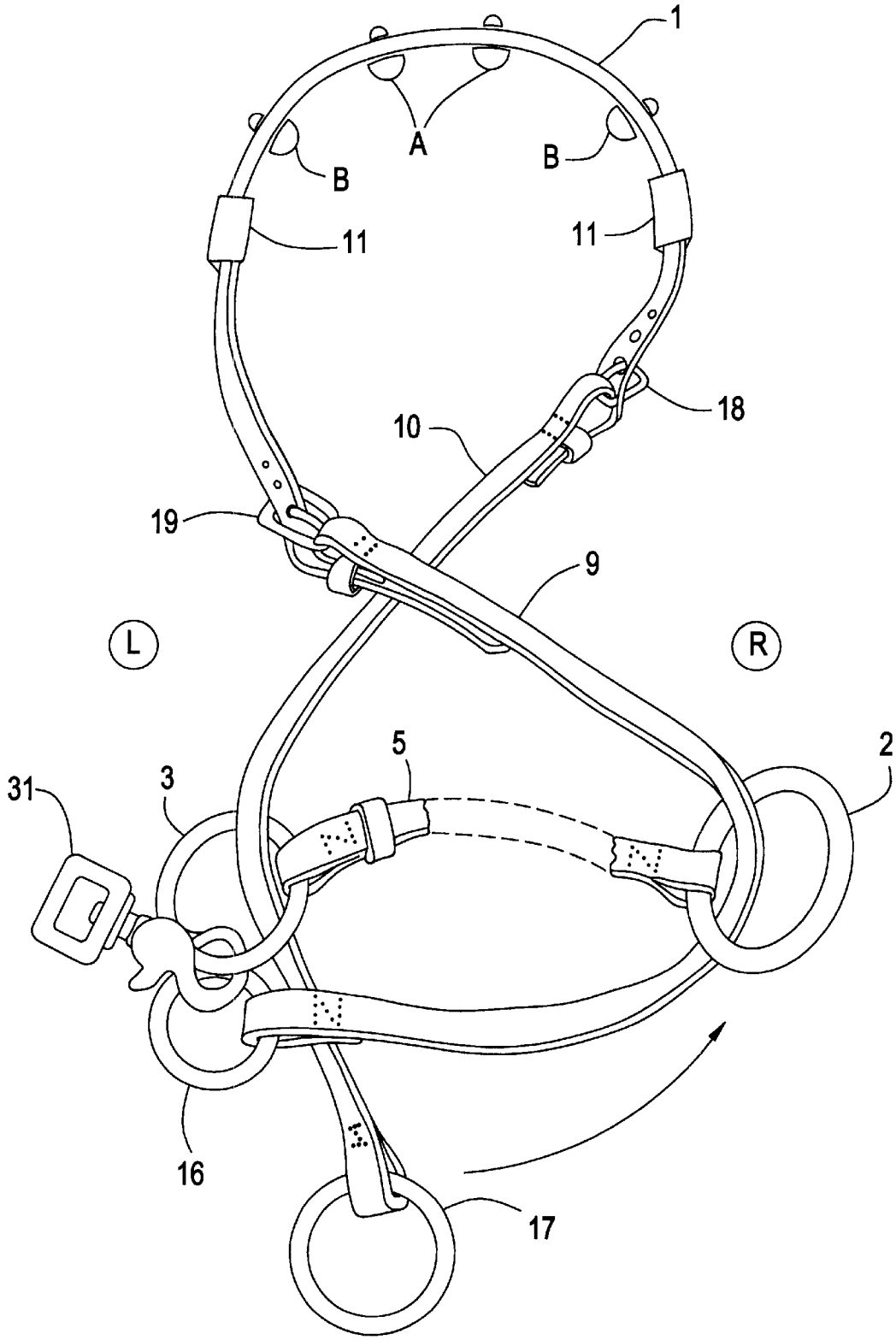
FIG. 8 is a perspective view of the cross-over straps, centerpiece and chin strap in a manner in which the bridle can be converted into a stable halter for the purpose of tying up a horse.

FIGS. 7 and 8 illustrate how the bitless bridle can be quickly and easily converted into a lead halter or a stable halter (head collar). Such versatility is particularly useful for trail riders, who, as a result of such a design can now ride, lead or tie their horse with the same piece of equipment. As shown in FIG. 7, the two rings 16, 17 are united with snap mechanism 30 and, during a trail ride for example, the reins 24, 25 are taken over the head of the horse and used as a lead shank. Alternatively, for in-hand leading at home, a standard lead shank can be attached to the now united rings 16, 17. FIG. 8 illustrates how the conversion into a stable halter is accomplished using a scissor snap mechanism 31, making use of the crossover pieces 9, 10. The snap 31 unites the ring 16 with the ring 3 and the ring 17 with the ring 2. Similarly, the bridle headstall also serves as the foundation for either a racing bridle having preferably one inch (1 in.) width reins, or, an English or Western style bridle having preferably five-eighths inch (⅝ in.) reins. To use the head harness for longeing in the head-collar mode, the longe line is threaded through ring 3, from outside to inside, and attached to ring 2. To use the head harness for long reining in the bridle mode, lines are attached to the rings 16, 17 in the normal fashion.

I claim:

1. A bitless bridle for controlling and restraining an animal through a pair of reins connectable thereto, said bitless bridle comprising:

a harness assembly for attachment to the head of the animal and including a first elongated strap extending over the poll area and behind the ears and downward along the head of the animal;

a second elongated strap for applying direct pressure to regions of special acuity located at a poll area and behind the ears of the animal, said second elongated strap extending parallel to but moving independent relative to said first elongated strap to transmit pressure to the regions of special acuity when rearward tension is applied to at least one of the pair of reins;

a third elongated strap extending across the animal's head in front of the ears of the animal for maintaining the position of said first elongated strap and said second elongated strap; and a restraining mechanism fixed relative to said harness assembly for preventing said third elongated strap from falling downward from a position below the base of the ears of the animal, said restraining mechanism including a first pair of loops through which said first elongated strap extends for engaging in relative movement during adjustment and a second pair of loops through which said second elongated strap extends for engaging in essentially free longitudinal movement relative to said harness assembly and independent of said first elongated strap when rearward tension is applied to at least one of the reins.

2. The bitless bridle according to claim 1, wherein said second elongated strap includes a pair of crossover straps which extend downward from said second elongated strap so as to pass under the chin of the animal.

3. The bitless bridle according to claim 2, further comprising a snap mechanism for attachment to said pair of crossover straps for converting said bitless bridle to a lead halter for leading the animal.

4. The bitless bridle according to claim 3, wherein said snap mechanism is attached to a respective one ring of said pair of crossover strap for converting said bitless bridle to a stable halter for tying the animal to a rigid structure.

5. The bitless bridle according to claim 2, wherein each crossover strap terminates in a connector mechanism for allowing said pair of crossover straps to be attached to the pair of reins.

6. The bitless bridle according to claim 5, wherein each said connector mechanism comprises a circular ring element.

7. The bitless bridle according to claim 6, further comprising a pair of sliding connectors fixedly attached to said harness assembly for creating a sliding connection for said crossover straps on the opposite sides of the animal's head adjacent to the mouth of the animal.

8. The bitless bridle according to claim 7, wherein said circular ring element extends beyond the sliding connectors by an amount sufficient to position said circular ring element in a variety of positions.

9. The bitless bridle according to claim 8, wherein said circular ring element is positioned approximately 3–7 inches below said sliding connectors.

10. The bitless bridle according to claim 1, wherein said restraining mechanism further comprises a clasping mechanism disposed between said first and second pair of loops to constrict said third elongated strap between said first and second elongated straps.

11. The bitless bridle according to claim 1, wherein said second elongated strap is provided with a plurality of protuberances for applying pressure to the regions of special acuity of the animal when rearward tension is applied to at least one of the reins.

12. The bitless bridle according to claim 11, wherein said plurality of protuberances are adjustably mounted to said second elongated strap to allow for custom fit to the head of the animal.

13. The bitless bridle according to claim 12, wherein said plurality of protuberances are composed of molded plastic.

14. The bitless bridle according to claim 2, further comprising a first adjustment mechanism for adjusting the length of the said crossover straps.

15. The bitless bridle according to claim 14, wherein said first adjustment mechanism comprises a buckle.

16. The bitless bridle according to claim 2, further comprising a second adjustment mechanism for adjusting the length of the said first elongated strap relative to the side of the head of the animal.

17. The bitless bridle according to claim 16, wherein said second adjustment mechanism comprises a buckle.

18. A bitless bridle for controlling and restraining an animal through a pair of reins connectable thereto, said bitless bridle comprising:

a harness assembly for attachment to the head of the animal and including a first elongated strap extending over the poll area and behind the ears and downward along the head of the animal;

a second elongated strap for applying direct pressure to regions of special acuity located at a poll area and behind the ears of the animal, said second elongated strap extending parallel to but moving independent relative to said first elongated strap to transmit pressure to the regions of special acuity when rearward tension is applied to at least one of the pair of reins; and a detachable sleeve for attachment to said second elongated strap, said sleeve being provided with a plurality of protuberances for applying pressure to the regions of special acuity when rearward tension is applied to at least one of the reins.

19. A bridle assembly for controlling and restraining an animal through a pair of reins connectable thereto, said bitless bridle comprising:

a harness assembly for attachment to the head of the animal and including a first elongated strap extending over the head and behind the ears and downward along the head of the animal;

a second elongated strap for applying direct pressure to regions of special acuity located at a poll area and behind the ears of the animal, the second elongated strap extending parallel to said first elongated strap to transmit the pressure to the regions of special acuity when rearward tension is applied to at least one of the pair of reins; and a restraining mechanism for restraining said first elongated strap and said second elongated strap to a position proximate to the poll area and behind the ears of the animal, said restraining means including a first pair of loops through which said first elongated strap extends for engaging in relative movement during adjustment and a second pair of loops through which said second elongated strap extends for engaging in essentially free longitudinal movement relative to said harness assembly and independent of said first elongated strap when rearward tension is applied to at least one of the reins, wherein said restraining mechanism is fixed relative to said harness assembly to allow free longitudinal movement of said second elongated strap relative to said harness assembly and independent of said first elongated strap when rearward tension is applied to at least one of the reins.

20. The bridle assembly according to claim 19, wherein said restraining mechanism further comprises a clasping mechanism disposed between said first and second pair of loops to constrict said third elongated strap between said first and second elongated straps.

* * * * *